US008622567B2

(12) United States Patent
Uzar

(10) Patent No.: US 8,622,567 B2
(45) Date of Patent: Jan. 7, 2014

(54) PORTABLE LIGHT SOURCE

(71) Applicant: Robert Timothy Uzar, Newnan, GA (US)

(72) Inventor: Robert Timothy Uzar, Newnan, GA (US)

( * ) Notice: Subject to any disclaimer, the term of this patent is extended or adjusted under 35 U.S.C. 154(b) by 0 days.

(21) Appl. No.: 13/764,214

(22) Filed: Feb. 11, 2013

(65) Prior Publication Data

US 2013/0155656 A1 Jun. 20, 2013

Related U.S. Application Data

(63) Continuation-in-part of application No. 12/477,614, filed on Jun. 3, 2009, now Pat. No. 8,371,707.

(51) Int. Cl.
*F21V 21/084* (2006.01)

(52) U.S. Cl.
USPC ..... 362/105; 362/103; 362/106; 362/107

(58) Field of Classification Search
USPC ..... 362/103–108
See application file for complete search history.

(56) References Cited

U.S. PATENT DOCUMENTS

| | | | | |
|---|---|---|---|---|
| 4,521,831 | A * | 6/1985 | Thayer | 362/106 |
| 6,616,294 | B1 * | 9/2003 | Henry | 362/106 |
| 7,549,763 | B2 * | 6/2009 | Kim et al. | 362/106 |
| 2008/0237422 | A1 * | 10/2008 | Dalton | 248/229.1 |

* cited by examiner

*Primary Examiner* — William Carter
(74) *Attorney, Agent, or Firm* — Laurence P. Colton; Smith Risley Tempel Santos LLC

(57) ABSTRACT

A portable light source for connection to a hardhat. The portable light source has a battery housing with an LED light mounted in a lamp holder that is connected either directly to or via a boom or wires to the battery housing. The housing or the lamp holder also has a mounting post that engages an aperture on the side of the hardhat for holding the portable light source in place. The lamp housing may be rotatably connected to the battery housing.

13 Claims, 4 Drawing Sheets

PORTABLE LIGHT SOURCE

STATEMENT OF RELATED APPLICATIONS

This application claims the benefit of U.S. patent application Ser. No. 12/477,614 filed on 3 Jun. 2009.

FIELD OF THE INVENTION

This invention relates to a portable light source that can be mounted on a hardhat.

BACKGROUND OF THE INVENTION

In an environment in which a worker is required to wear a hardhat, there may also exist a need for supplemental lighting to assist the worker in completing a task or inspecting work product. A conventional handheld flashlight commonly used in such situations occupies the use of one hand of the worker, leaving only one hand free to perform the required tasks. Alternatively, a second helper may be required simply to hold the flashlight while work is being accomplished. In order to free up both hands, a headlamp attached to a headband may be used to provide supplemental lighting to assist the worker in the task at hand. Such a headlamp with a headband may preclude the wearing of a hardhat. Also, a headlamp with a set of straps specifically designed for a hardhat may be strapped to the worker's hardhat in order to free up both of the workers hands. Such a headlamp with a set of straps may be cumbersome, expensive, and difficult to use.

SUMMARY OF THE INVENTION

The present invention addresses the difficulties encountered when a worker, required to wear a hardhat, must have supplemental light in order to perform an assigned task that requires both hands. Particularly, the present invention is a compact, lightweight, portable light source that clips into one or both side apertures on a conventional hardhat. A first embodiment of the portable light source includes a housing for containing a battery, a lamp holder rotatably connected to the housing and containing a lamp, preferably a light emitting diode (LED), and a mounting post attached to the housing for engaging a side aperture of the hardhat. A second embodiment of the portable light source includes a housing for containing a battery, a lamp holder fixedly connected to the housing and containing a lamp, preferably a light emitting diode (LED), and a mounting post attached to the housing for engaging a side aperture of the hardhat. A third embodiment of the portable light source includes a housing for containing a battery, a lamp holder containing a lamp, preferably a light emitting diode (LED), a mounting post attached to the lamp holder for engaging a side aperture of the hardhat, and a connector for connecting the housing and the lamp holder together. The portable light source further includes necessary wiring between the battery and the LED, as well as an interconnected switch to connect and disconnect the battery to and from the LED.

The side aperture on both sides of the conventional hardhat typically serves as a mounting mechanism for a facemask or for ear protection. The mounting post of the portable light source is configured and dimensioned to fit into the side aperture on either side of the hardhat. In addition, the mounting post includes a resilient clip that flexes as the mounting post is inserted into the side aperture and engages the side aperture once the mounting post has been completely inserted into the side aperture to hold the portable light source firmly in place within the side aperture.

In the first embodiment, the lamp holder of the portable light source can rotate approximately 360° with respect to the housing, the portable light source can be fitted to either side of the hardhat with the LED facing forward or two portable light sources can be fitted to both sides of the hardhat with both LEDs facing forward. In the second embodiment, the lamp holder does not rotate and lamp holders having mirror structures relative to each other can be used on either side of the helmet. In the third embodiment, the portable light source can either rotate or not rotate. With two portable light sources mounted on each side of the hardhat, the hardhat is balanced, and the light from the two portable light sources is spread over a broader field of vision. Further, with rotatable lamp holders, rotating the lamp holder with respect to the housing, allows the LED to be aimed to provide optimum lighting.

Further objects, features and advantages will become apparent upon consideration of the following detailed description of the invention when taken in conjunction with the drawings and the appended claims.

DETAILED DESCRIPTION OF THE EMBODIMENTS OF THE INVENTION

Figure 1:
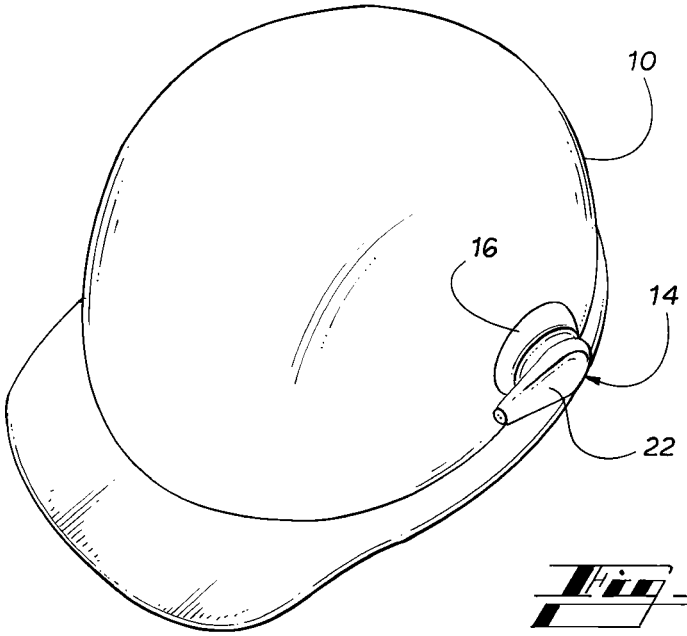
FIG. 1 is a front perspective view of the portable light source attached to a conventional hardhat in accordance with the present invention.
Figure 2:
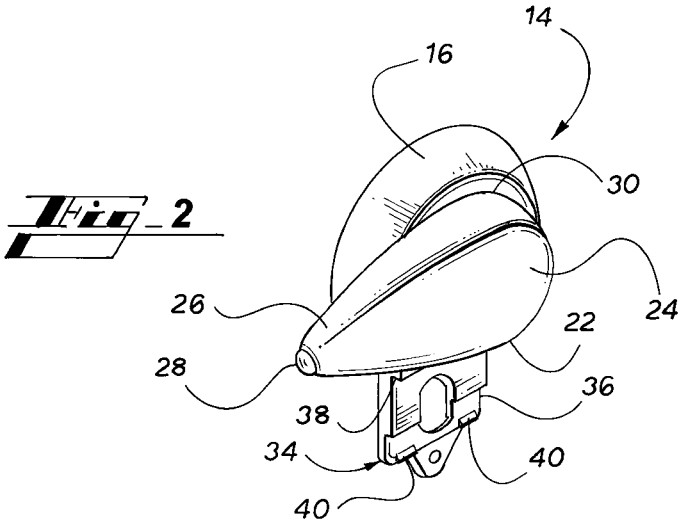
FIG. 2 is a front perspective view of the portable light source in accordance with the present invention.
Figure 3:
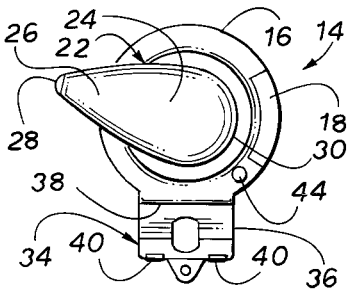
FIG. 3 is a side elevation view of the portable light source in accordance with the present invention.
Figure 6:
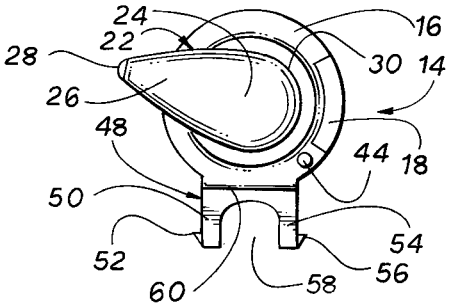
FIG. 6 is a side elevation view of a second embodiment of the portable light source in accordance with the present invention.
Figure 4:
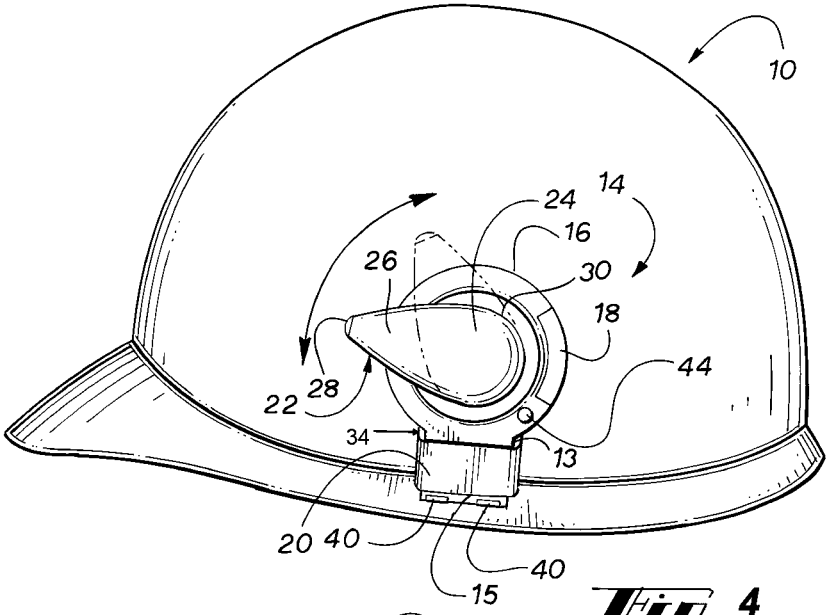
FIG. 4 is a side elevation view of the portable light source attached to a conventional hardhat in accordance with the present invention embodiment of a rotatable lamp holder.
Figure 7:
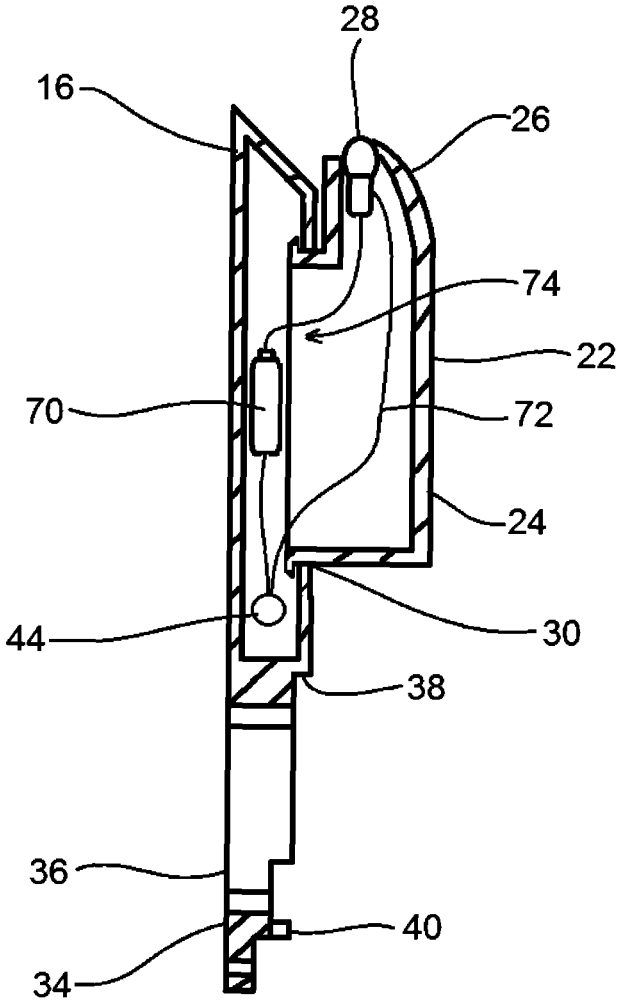
FIG. 7 is a side cross sectional view of the portable light source as shown in FIG. 3 generally along a vertical plane extending into the page in accordance with the present invention.
Figure 8:
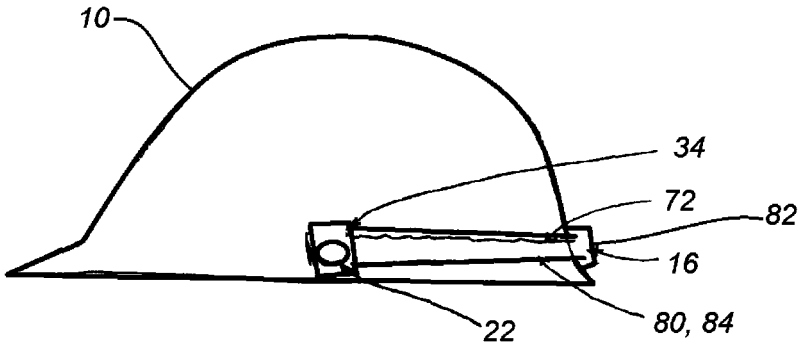
FIG. 8 is a side view of a third embodiment of the portable light source in accordance with the present invention.
Figure 9:
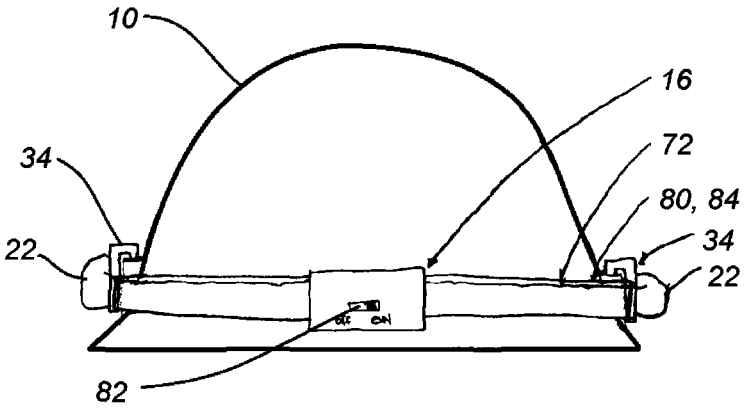
FIG. 9 is a rear view of the third embodiment shown in FIG. 8.

FIGS. 1 and 3 show a portable light source 14 constructed in accordance with the present invention. FIGS. 2 and 4 show the portable light source 14, in accordance with the present invention, attached to a conventional hardhat 10. FIG. 6 shows a second embodiment of the portable light source 14. FIG. 7 shows a cross-section of the invention generally representative of the first and second embodiments. FIGS. 8 and 9 show a third embodiment of the portable light source 14 with the housing 16 containing the battery 70 separate from the lamp holder 22.

Turning to FIGS. 1, 3 and 7, the portable light source 14 comprises a housing 16, a lamp holder 22, and a mounting post 34. The housing 16 is generally round or oval in shape and is generally hollow to accommodate a battery compartment covered by an access panel 18 and a battery 70 within the battery compartment. An electric switch 44 is mounted on the housing 16. The mounting post 34 is fixed to the bottom of the housing 16 and extends from the housing 16. The lamp holder 22 can be rotatably connected to the housing 16 by means of a pivot joint 30, as shown in FIG. 4, or can be non-rotatably connected to the housing 16, which also is represented in FIGS. 1-3 and 6-7.

The lamp holder 22 comprises a generally hollow body 24 and generally hollow extension 26. A light emitting diode (LED) 28 is mounted within the extension 26. If the pivot joint is present, the pivot joint 30, which rotatably connects the body 24 of the lamp holder 22 to the housing 16, includes an opening 74 between the hollow housing 16 and the hollow lamp holder 22 to accommodate wires 72 from the battery 70 in the hollow housing 16 to the LED in the lamp holder 22. Alternatively, the battery 70 could be mounted within hollow body 24 of the lamp holder 22 thereby eliminating the need for an opening 74 between the housing 16 and the lamp holder 22. The pivot joint 30 is configured so that sufficient friction exists between the body 24 of the lamp holder 22 and the housing 16 so that the lamp holder 22 can be rotated to any particular position within a 360° arc, and the friction in the pivot joint 30 will retain the lamp holder 22 in that relative orientation to the housing 16. If the pivot joint is not present, the connection between the body 24 of the lamp holder 22 and the housing 16 also includes an opening 74 between the hollow housing 16 and the hollow lamp holder 22 to accommodate wires 72 from the battery 70 in the hollow housing 16 to the LED in the lamp holder 22.

As will be appreciated by those of ordinary skill in the art, wires 72 connect the LED 28 to the battery 70 in the compartment covered by access panel 18 through the switch 44.

Figure 5:
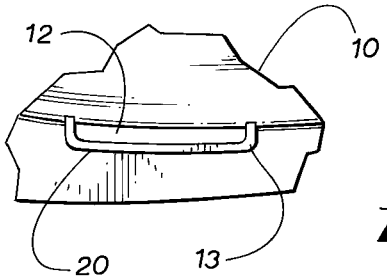
FIG. 5 is a top plan detailed view of the side aperture of the hardhat shown in FIGS. 1 and 5.

The mounting post 34 is configured and dimensioned to fit into a side aperture 12 of the hardhat 10. The side aperture 12, shown in FIGS. 4 and 5, is created by loop member 20, with a top and bottom opening, molded into the side of the hardhat 10. The side aperture 12 is located on each side of the hardhat 10 just above the ear of the wearer. The mounting post 34 shown in FIGS. 2 and 3 comprises a stop 38 at the proximal end of the mounting post 34 and a clip fastener 32. The clip fastener 32 comprises a resilient leg 36 extending from the stop 38, and keepers/cams 40 located at the distal end of the mounting post 34. In the first and second embodiments, the mounting post preferably extends from the housing 16, and in the third embodiment, the mounting post 34 preferably extends from the lamp holder holder 22.

In use, the mounting post 34 is inserted into the side aperture 12 of the hardhat 10. The keepers/cams 40 engage the inside of the side aperture 12, and the resilient leg 36 is forced inwardly toward the hardhat 10 by the camming action of the keepers/cams 40 so that the mounting post 34 can slide into the side aperture 12. Once the mounting post 34 is fully inserted into the side aperture 12 and the stop 38 has engaged the top 13 of the loop member 20 of the side aperture 12, the keepers/cams 40 clear the bottom 15 of the loop member 20 of the side aperture 12. Once the keepers/cams 40 clear the bottom 15 of the loop member 20 of the side aperture 12, the keepers/cams 40 engage the bottom 15 of the loop member 20 of the side aperture 12 and hold the mounting post 34 within the side aperture 12. In that manner, the portable light source 14, secured within the side aperture 12, is securely mounted to the hardhat 10.

In an alternative embodiment, a mounting post 48 has a stop 60 at its proximal end a clip fastener 62. The clip fastener 62 comprises two downwardly extending resilient legs 50 and 54 separated by a split 58. Each leg has a keeper/cam 52 and a keeper/cam 56 respectively at its distal end. The resilient legs 50 and 54 are compressed together by the camming action of the keepers/cams 52 and 56 when the mounting post 48 is inserted into the loop member 20 of the side aperture 12. Once the mounting post 48 has been fully inserted into the side aperture 12 and the stop 60 engages the top 13 of the loop member 20 of the side aperture 12, the keepers/cams 52 and 56 are forced outwardly by the resiliency of the legs 50 and 54 and engage the bottom 15 of the loop member 20 of the side aperture 12 of the hardhat 10.

In the first embodiment, in which the lamp holder 22 is shown in a first position (solid lines) and a second position (dashed lines) in FIG. 4, the lamp holder 22 can be rotated to various positions relative to the housing 12, such as pointing generally forward, as shown in the first position, or pointing generally upwards, as shown in the second position. The pivot joint 30 can be structured so that the lamp holder 22 can be rotated to any particular position within a 360° arc, and the friction in the pivot joint 30 will retain the lamp holder 22 in that relative orientation to the housing 16. Alternatively, the pivot joint 30 can be structured to allow the lamp holder to rotate to set positions or to positions within an arc smaller than 360°.

In the second embodiment, in which the lamp holder 22 is shown in only one position (solid lines) such as in FIG. 2, the lamp holder 22 is not rotatable and will remain in the set position relative to the housing 12, such as pointing generally forward, as shown in FIG. 2. In this second embodiment, the lamp holder 22 can be rigidly attached to the housing 16, such as for example by adhesives, heat or sonic welding, or non-rotatable clips or snaps.

In the third embodiments, in which the lamp holder 22 and the housing 16 are separate from each other as shown in FIGS. 8 and 9, the lamp holder 22 comprises the mounting post 34 and the lamp holder 22 is mounted into the loop member 20 of the side aperture 12. In a preferred embodiment, two lamp holders 22 are used, one on each side of the hardhat 10, and an elastic strap 80 extends from the rear side of each of the lamp holders 22 to the housing 16, with a first end of each respective elastic strap 80 attached to the lamp holder 22 and a second opposite end of each elastic strap 80 attached to the housing 16. Thus, the housing 16 is held against the rear of the hardhat 10 by the action of the elastic straps. Wires 72 extend between the battery 70 in the housing to the LED in the lamp holder 22. Alternatively, instead of an elastic strap 80, a boom member 84 extends from the rear side of the lamp holder 22 to the housing 16, with a first end of the boom member 80 attached to the lamp holder 22 and a second opposite end of the boom member 80 attached to the housing 16. The wires can be located outside of the boom member 80 or within a cavity through the boom member 80. An on-off switch 82 can be mounted on the housing 16 to activate the LED.

In the third embodiments, one, two, or more lamp housings 22 can be used, preferably one or two, and even more preferably two, all preferably attached electrically or physically and electrically to the same housing 16. If two lamp housings 22 are used, each lamp housing 22 can have an elastic strap 80 or a boom member 84 connecting the respective lamp housing to the housing 16. As shown in FIG. 9, one elastic strap 80 or boom member 84 can extend from each side of the housing 16 to the respective lamp holder 22 on either side of the hardhat 10. Similarly, wires 72 can extend from a battery 70 to a respective LED in a respective lamp holder 22. Housing 16 can be physically attached to the hardhat 10 via adhesives, clips, tapes, or the like, or can be supported against or proximal to the hardhat 10 via the elastic straps 80 or boom members 84. Boom members 84 can be rigid or flexible members made of any suitable material, such as for example, metal or plastic. In the third embodiments, each lamp holder 22 can comprise a pivot joint 30 and be rotatable, or not comprise a pivot joint 30 and not be rotatable. In one embodiment, two pivotable lamp holders 22 can be used, in another embodiment, two non-pivotable lamp holders 22 can be used, and in yet another embodiment, one pivotable and one non-pivotable lamp holder 22 can be used.

While this invention has been described with reference to preferred embodiments thereof, it is to be understood that variations and modifications can be affected within the spirit and scope of the invention as described herein and as described in the appended claims.

What is claimed is:

1. A portable light source for mounting on a hardhat having a side aperture, the portable light source comprising:

a) a housing holding a battery;

b) a lamp holder, for supporting a lamp, mounted to the housing;

c) an opening between the housing and the lamp holder; and d) a mounting post fixed to the housing and having a resilient clip fastener, wherein wires between the battery and the lamp pass through the opening between the housing and the lamp holder, and wherein the mounting post is configured and dimensioned to fit into the side aperture of the hardhat, and the clip fastener engages the side aperture to secure the portable light source to the hardhat.

2. The portable light source of claim 1, wherein the lamp holder includes a hollow body for holding a battery.

3. A portable light source for mounting on a hardhat having a side aperture, the portable light source comprising:

a) a housing holding a battery;

b) a lamp holder, for supporting a lamp;

c) a connecting member connecting the lamp holder to the housing, wherein the connecting member is a boom;

d) electrical wires for connecting the battery to the lamp; and e) a mounting post fixed to the lamp holder and having a resilient clip fastener, wherein the mounting post is configured and dimensioned to fit into the side aperture of the hardhat, and the clip fastener engages the side aperture to secure the portable light source to the hardhat, and wherein the housing is separately supported by the connecting member.

4. The portable light source of claim 3, further comprising a pivot joint between the lamp housing and the mounting post, wherein the pivot joint is configured so that the lamp holder is rotatable relative to the mounting post.

5. The portable light source of claim 4, wherein the pivot joint is configured so that the lamp holder is rotatable relative to the mounting post to any position within a 360° arc.

6. The portable light source of claim 3, comprising two lamp holders and only one housing, wherein the two lamp holders are connected to the one housing.

7. A combination hardhat and light source, comprising:

a) a hardhat having a side aperture; and b) a portable light source for mounting on the hardhat, the portable light source comprising:

i) a housing;

ii) a lamp holder, for supporting a lamp, mounted to the housing;

iii) an opening between the housing and the lamp holder; and iv) a mounting post fixed to the housing and having a resilient clip fastener, wherein the mounting post is configured and dimensioned to fit into the side aperture of the hardhat, and the clip fastener engages the side aperture to secure the portable light source to the hardhat, and wherein the housing holds a battery, and wires between the battery and the lamp pass through the opening between the housing and the lamp holder.

8. The combination hardhat and light source of claim 7, wherein the side aperture is a loop member having a top and bottom opening molded into a side of the hardhat.

9. The combination hardhat and light source of claim 7, wherein the hardhat further comprises two side apertures, and wherein the mounting post is configured and dimensioned to fit into either of the two side apertures of the hardhat.

10. A combination hardhat and light source comprising:

a) a hardhat comprising a side aperture; and b) a portable light source for mounting on the hardhat, the portable light source comprising:

i) a housing holding a battery;

ii) a lamp holder, for supporting a lamp;

iii) a connecting member connecting the lamp holder to the housing, wherein the connecting member is a boom;

iv) electrical wires for connecting the battery to the lamp; and v) a mounting post fixed to the lamp holder and having a resilient clip fastener, wherein the mounting post is configured and dimensioned to fit into the side aperture of the hardhat, and the clip fastener engages the side aperture to secure the portable light source to the hardhat, and wherein the housing is separately supported by the connecting member.

11. The portable light source of claim 10, further comprising a pivot joint between the lamp housing and the mounting post, wherein the pivot joint is configured so that the lamp holder is rotatable relative to the mounting post.

12. The portable light source of claim 11, wherein the pivot joint is configured so that the lamp holder is rotatable relative to the mounting post to any position within a 360° arc.

13. The portable light source of claim 10, comprising two lamp holders and only one housing, wherein the two lamp holders are connected to the one housing.

* * * * *